United States Patent [19]

Toda et al.

[11] 4,233,149

[45] Nov. 11, 1980

[54] ANODE SUPPORT MEMBER

[75] Inventors: Kazuo Toda; Tadashi Hosoda, both of Urawa; Yutaka Matsuo, Tokyo, all of Japan

[73] Assignee: Mitsubishi Kinzoku Kabushiki Kaisha, Tokyo, Japan

[21] Appl. No.: 12,125

[22] Filed: Feb. 14, 1979

[51] Int. Cl.[3] ..... C25B 11/10; C25D 17/04; C25D 17/06; C25D 17/12

[52] U.S. Cl. ..... 204/297 W; 204/290 F; 204/293

[58] Field of Search ..... 204/293, 297 W, 58, 204/290 F

[56] References Cited

U.S. PATENT DOCUMENTS 3,176,850 4/1965 Rosner ..... 204/297 W

*Primary Examiner*—Howard S. Williams
*Attorney, Agent, or Firm*—Darby & Darby

[57] ABSTRACT

To ensure anodic oxidation treatment for aluminum or aluminum alloy products with less electric power loss and longer durability at reduced operating cost a useful anode member constructed of zirconium alloy is proposed in accordance with the present invention, which serves to carry thereon aluminum or aluminum alloy products to be anodized and acts as electric contact through which current is fed.

19 Claims, 16 Drawing Figures

ANODE SUPPORT MEMBER

BACKGROUND OF THE INVENTION

The present invention relates generally to an anode member in use for a variety of electrolytic treatments, and particularly to an anode member such as rack means on which products of aluminum or aluminum alloy (hereinafter referred to as aluminum material) are suspended for anodic oxidation treatment.

Hitherto pure aluminum or aluminum alloy is mainly used as anode member for anodic oxidation treatment of products of aluminum material and in a specific case titanium is used for the same purpose to some extent. Aluminum material as anode member, however, has drawbacks as described below. Namely anode member immersed in the electrolyte is anodized together with the aluminum products, since the former is made of the same material as the latter. This causes high electric power loss, because the anode member has current flow-out therefrom at almost the same current density as the aluminum products. As the anode member is subjected to anodic oxidation treatment, it has an anodized film formed on the surface thereof in the same manner as the aluminum products.

Since the anodized film has no conductivity, the film should be removed prior to reusing the anode member so as to assure electric contact. In practical operation this non-conductive film may be dissolved using alkali. Alternatively, removal of the non-conductive film may be carried out at the same time as degreasing, chemical polishing or the like is performed as pre treatment. Due to a fact that formation and removal of the anodized film are repeated over the anode member of aluminum material every time when aluminum products are anodized, resulting in gradual wearing thereof, it becomes necessary that the anode member is replaced with new one, even though it has still mechanical strength sufficient to carry the aluminum products thereon. As a result cost of anode member in total operation cost is not negligible. Moreover it is to be noted as another problem that a considerable quantity of chemicals is consumed for removal of the anodized film.

On the other hand, in case that titanium is employed for anode member, it has very thin anodized film which is generated during anodic oxidation and this anodized film is easy to be broken away by means of force caused in the course of racking for the aluminum products. Thus different from the anode member of aluminum which requires removal of anodized film prior to anodic oxidation treatment, the anode member of titanium has no requirement of removal of anodized film, which enables the anode member of titanium to be repeatedly utilized for a long period of time. Further titanium anode member has very little current flow-out therefrom during anodic oxidation treatment, whereby it has power loss remarkably less than that of aluminum. For the reasons as mentioned above titanium is important material for racking member in use for heavy aluminum products, elongated aluminum products such as aluminum sash or the like as well as anode member for anodic oxidation at high current density, because anode member of titanium has a variety of advantages over that of aluminum and additionally has a substantially high springiness in comparison with the latter.

In spite of the excellent advantage of less wearing during anodic oxidation treatment, however, the anode member of titanium has a drawback that it is subjected to hydrogen embrittlement which is caused by environmental corrosion (mainly corrosion by sulfuric acid) during serial processes of anodic oxidation treatment. Thus it is pointed out as a disadvantage in practical use as anode member that titanium anode members may be broken or damaged in racking because of the aforesaid hydrogen embrittlement as they are repeatedly used.

As mentioned above, the conventional anode member of aluminum or aluminum alloy or titanium has drawbacks inherent thereto and accordingly fails to meet all requirements for anode member.

SUMMARY OF THE INVENTION

An object of the present invention is to provide an anode member for anodic oxidation treatment, which has less power loss and wearing and higher resistivity against corrosion in a variety of electrolytes and solutions therefor.

Other objects and advantages of the present invention will be readily apparent to one skilled in the art from the following description.

To accomplish the aforesaid objects an anode member for anodic oxidation treatment constructed of zirconium alloy is provided in accordance with the present invention.

BRIEF DESCRIPTION OF THE ACCOMPANYING DRAWINGS

Now the present invention will be described in more detail with reference to the accompanying drawings illustrating the characteristic advantages and preferred embodiments of the invention, in which.

DETAILED DESCRIPTION OF THE INVENTION

Figure 1:
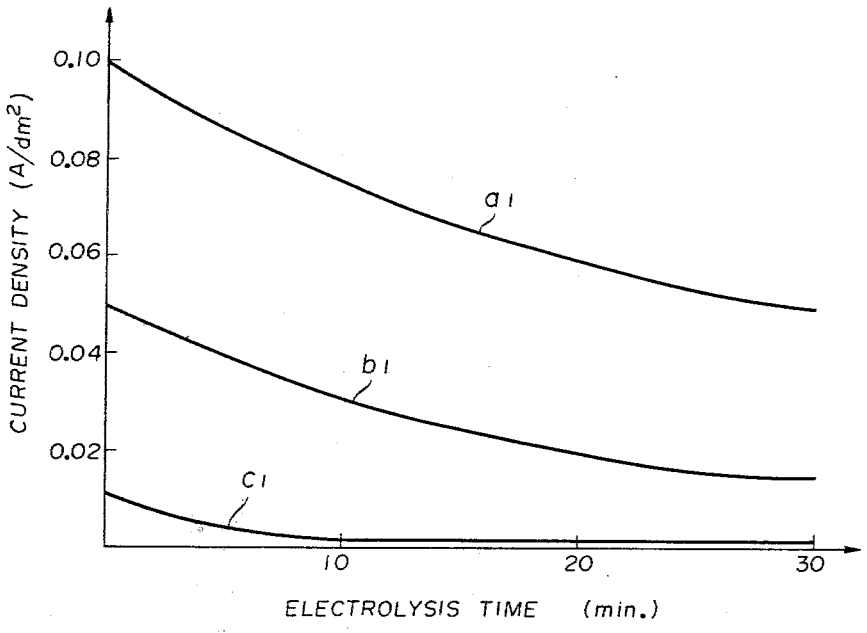
FIG. 1 is a diagram illustrating a curve of current density flowing out of a zirconium alloy anode member of the invention in the course of anodic oxidation treatment in comparison with that of other metallic materials.

Basically an anode member in accordance with the present invention is constructed of zirconium alloy.

Typical zirconium alloy employed for the invention is zirconium alloy consisting of 1.2–1.7 wt % Sn, 0.07–0.20 wt % Fe, 0.05–0.15 wt % Cr, 0.03–0.08 wt % Ni, 0.18–0.38 wt % Fe+Cr+Ni and the remainder zirconium (hereinafter referred to as zirconium alloy A), or zirconium alloy consisting of 1.2–1.7 wt % Sn, 0.18–0.24 wt % Fe, 0.07–0.13 wt % Cr, 0.28–0.37 wt % Fe+Cr and the remainder zirconium (hereinafter referred to as zirconium alloy B). Further another zirconium alloy is also available, which consists of 0.05–3.0 wt % Sn, 0.001–4.5 wt % Hf, 0.001–1.0 wt % Fe, 0.001–1.0 wt % Cr, 0.001–1.0 wt % Ni, 0.05–0.5 wt % 0, 0.001–0.05 wt % N, 0.001–0.2 wt % one or more than one elements selected from Cu, Co, Cd, Mn, Al, Ti, Si, C, P, Mo, Bi, V, Sb, Nb, W and B and the remainder zirconium (hereinafter referred to as zirconium alloy C).

Moreover, still another zirconium alloy containing 1–3 wt % Nb is also available (hereinafter referred to as zirconium alloy D). This zirconium alloy D is classified as listed in Table 1, any of classified ones being applicable to the practical use.

TABLE 1

| | composition of alloys | | | | | |
|---|---|---|---|---|---|---|
| | composition in wt % | | | | | |
| | Nb | Sn | Cr | Mo | Pb | Zr |
| zirconium alloy D | 2 | 1 | 0.3 | — | — | bal. |
| " | 2 | 1 | — | 0.3 | — | bal. |
| " | 3 | 1 | — | — | 0.2 | bal. |
| " | 3 | 1 | — | — | — | bal. |
| " | 3 | — | — | — | — | bal. |
| " | 1 | — | — | — | — | bal. |

Any one selected from those zirconium alloys as listed above is employed for the present invention.

Anode current (current density) flowing out from the surface of anode member for which zirconium alloys A, B, C and D are used as anode member will be described below in comparison with aluminum, titanium and zirconium.

Electrolytic bath is filled with 15% $H_2SO_4$ solution at 20° C. and electrolysis is effected at a constant voltage of 20 V. The results are shown in Table 2 and FIG. 1.

It is to be noted that line $a_1$ denotes a current density curve in case of titanium used for anode member, line $b_1$ denotes a current density curve in case of zirconium used for anode member and line $c_1$ denotes a current density curve in case of zirconium alloy A used for anode member.

Current density curve of zirconium alloy B, C or D is substantially same to that of zirconium alloy A. Thus detailed description of the latter is eliminated.

TABLE 2

| | current density (A/dm$^2$) | |
|---|---|---|
| anode member | just after starting electrolysis | after 30 min. elapsed |
| aluminum | 2.0 | 1.5 |

TABLE 2-continued

| | current density (A/dm$^2$) | |
|---|---|---|
| anode member | just after starting electrolysis | after 30 min. elapsed |
| titanium | 0.1 | 0.05 |
| zirconium | 0.05 | 0.015 |
| zirconium alloy A,B | 0.01 | 0.002 |
| zirconium alloy C | 0.01 -0.015 | 0.002–0.003 |
| zirconium alloy D | 0.013–0.018 | 0.002–0.004 |

As obvious from Table 2 and FIG. 1, flow-out current of zirconium alloys A, B, C and D is negligible small in comparison with that of titanium or zirconium. Moreover it is remarkable that change in weight amounts to 4 mg/dm$^2$ with titanium and 0.05 mg/dm$^2$ in case of zirconium, after electrolysis for 30 minutes respectively, while the same is almost zero with zirconium alloys A, B, C and D.

It therefore can be concluded that problems of wearing of anode member caused during anodic oxidation as well as electric power loss due to current flow-out from the anode member itself can be more advantageously resolved with the use of zirconium alloys A, B, C and D than in case of titanium used as anode member as well as in case of zirconium, which is a main component of zirconium alloys A, B, C and D. Further it should be emphasized that zirconium alloys A, B, C and D are formed with anodized film on the surface thereof during anodic oxidation treatment respectively in the same manner as titanium does, and said anodized film is so thin (normally several hundred Å in thickness) that additional operation of removing the anodized film prior to starting anodization again is not required because of a fact that this film is easily destroyed by means of pressure which is caused during setting of aluminum products on a rack. This means that anode member of zirconium alloy A, B, C and D can be repeatedly used for a long period of time without substantial wearing. Further since zirconium alloys A, B, C and D have almost the same mechanical strength as titanium does, anode member made of zirconium alloy A, B, C and D can be put in use for anodic oxidation treatment of heavy and elongated aluminum products in the same manner as titanium anode member can.

Incidentally, as well known, titanium in use for anode member has considerably less conductivity than that of aluminum, while zirconium alloys A, B, C and D in use for the present invention has less conductivity than that of titanium. But no problem takes place in practical use with zirconium alloy A, B, C or D, because there is caused very little voltage drop due to the electric resistance thereof.

Resistivity of each anode member against corrosion in anolyte during anodic oxidation treatment will be described below with reference to Tables 3 and 4.

Table 3 shows weight loss and corrosion rate of zirconium alloys A, B, C or D which are immersed in 10% sulfuric acid or 10% sodium hydroxide at 70° C. for 5.5 hr respectively.

TABLE 3

| | | weight loss | corrosion rate | |
|---|---|---|---|---|
| solution | anode member | (mg/dm$^2$) | (mg/dm$^2$/day) | (mm/year) |
| $H_2SO_4$ solution | titanium | 70 | 305 | 2.5 |
| | zirconium | 15 | 65 | 0.4 |
| | zirconium alloy A,B | 5 | 22 | 0.13 |

TABLE 3-continued

| solution | anode member | weight loss (mg/dm²) | corrosion rate (mg/dm²/day) | corrosion rate (mm/year) |
|---|---|---|---|---|
| | zirconium alloy C | 6 | 26 | 0.15 |
| | zirconium alloy D | 7 | 31 | 0.17 |
| NaOH | zirconium alloy A,B | 6 | 26 | 0.15 |
| solution | zirconium alloy C | 7 | 31 | 0.17 |
| | zirconium alloy D | 8 | 35 | 0.20 |

As apparent from Table 3, the corrosion rate (mm/year) of zirconium alloys A and B in sulfuric acid solution is only 1/20 of that of titanium, zirconium alloy C is 1/17 and zirconium alloy D is 1/15 respectively. Moreover it has been found out that zirconium alloys A, B, C and D have sufficiently high resistivity against corrosion in alkali solution.

Table 4 shows corrosion rate of titanium, zirconium alloys A, B, C and D respectively, after chemical polishing is carried out at 105° C. for 5 min. using chemical polishing agent (trade name: Lasabright), main components of said agent being phosphoric acid and nitric acid.

TABLE 4

| anode member | corrosion rate (mg/dm²/day) | corrosion rate (mm/year) |
|---|---|---|
| titanium | 1480 | 11.9 |
| zirconium alloy A,B | 414 | 2.3 |
| zirconium alloy C | 420 | 2.4 |
| zirconium alloy D | 445 | 2.5 |

As apparent from Table 4, zirconium alloys A, B, C and D have resistivity in chemical polishing agent about five times as high as that of titanium respectively.

It therefore can be concluded that the anode member in accordance with the present invention is able to be used for the time length about five times as long as the durability of titanium.

Further it is to be noted that zirconium alloys A and B as anode member can be used for the considerably long period of time in view of a fact that zirconium alloys A and B have very little corrosion rate of 2.3 mm/year in the chemical polishing agent as shown in Table 4 and each polishing is carried out for a short time. Assuming that for instance single chemical polishing lasts for 2 min. and 20 operations are performed in a day, accumulative corrosion rate per year amounts to 0.064 mm/year. It is readily recognized that this extent of corrosion doesn't bring any remarkable hindrance to practical operation. This is the same with zirconium alloys C and D.

Figure 2:
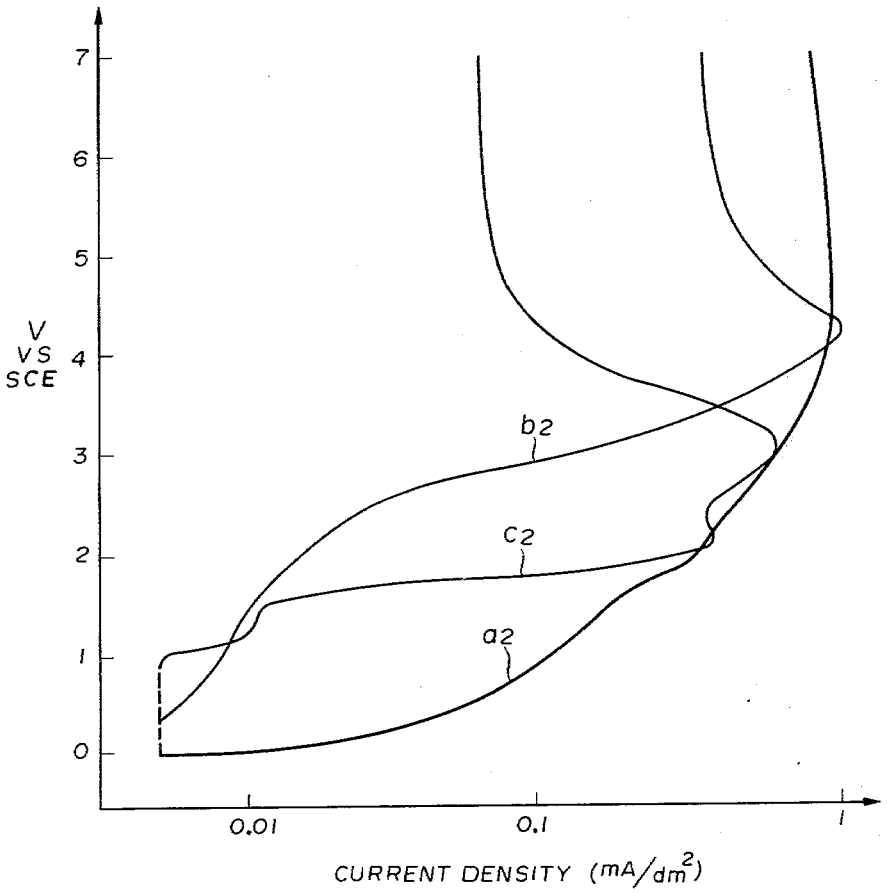
FIG. 2 is a diagram illustrating the characteristics of polarization of the zirconium alloy anode member in comparison with that of other metallic materials.

In fact the aforesaid high resistivity of zirconium alloys A, B, C and D against corrosion and higher resistivity of zirconium alloys A and B against corrosion than that of zirconium have been well proven by means of characteristics of anode polarization as mentioned below. Namely, characteristics of anode polarization (using potentiostat at 25 min/V) in 15% sulfuric acid solution at 20° C. were measured with zirconium alloys A, B, C and D and zirconium as well as titanium respectively, and the results as shown in FIG. 2 were obtained. In FIG. 2 line $a_2$ denotes a curve of characteristics of anode polarization in case of titanium, line $b_2$ denotes a curve of characteristics of anode polarization in case of zirconium, and line $c_2$ denotes a curve of characteristics of anode polarization in case of zirconium alloy A. Incidentally characteristics of anode polarization with zirconium alloys A, B, C and D are eliminated from illustration in FIG. 2, because characteristics of anode polarizations are same to those in case of zirconium alloy A.

As seen from FIG. 2, zirconium alloys A, B, C and D are more readily passivated than zirconium and titanium. This means that the former has higher resistivity against corrosion than the latter, particularly than zirconium.

As obvious from the results of a variety of experiments as described above, zirconium alloys A, B, C and D have remarkably excellent properties of performance as material for anode member and resistivity against pre treatment agent over those of titanium or aluminum.

Since zirconium alloy is hitherto used in a limited scope of application, scrapped or rejected zirconium alloy such as wrong manufactured products, short dimensioned products, cut ends or the like is very difficult to utilize for another useful application. This causes zirconium alloy to be manufactured at a high cost, which contains expensive zirconium as a main component. As proposed in accordance with the invention, utilization of scrapped zirconium alloy for anode member makes it possible to widen the scope of useful application of the same, resulting in reduced manufacturing cost thereof.

FIGS. 3 through 8 illustrate an embodiment of the invention, in which a racking frame is constructed of scrap of zirconium alloy tube. The reference numeral 10 denotes a framework which is made by bending scrap of zirconium alloy cylindrical tube to a rectangle, said framework 10 being dimensioned such that for instance the elongated parts (longitudinal parts) 10*a* and 10*b* have about 700 mm in length, while the short parts (upper or lower horizontal portion) 10*c* and 10*d* have about 500 mm in width. In fact this framework 10 is formed by joining the both ends of the zirconium alloy tube at the central part of the upper horizontal portion 10*c* and 12. A current-feeding member 13 having high conductivity such as aluminum is fastened to the connected part 12 and further a straight tubular reinforcement 14 of zirconium alloy tube is vertically extended between said connected part 12 and the center of the lower horizontal portion 10*d*.

Figure 4:
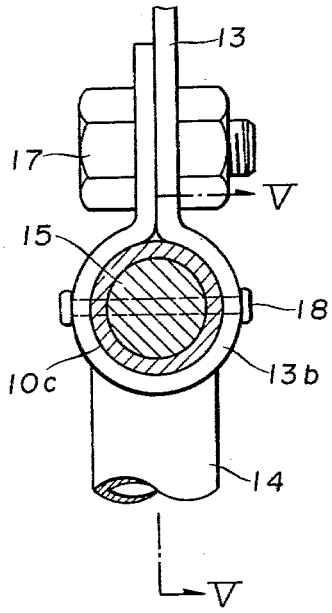
FIG. 4 is a cross sectional view of the first embodiment taken in line IV—IV in FIG. 3, shown in an enlarged scale.
Figure 5:
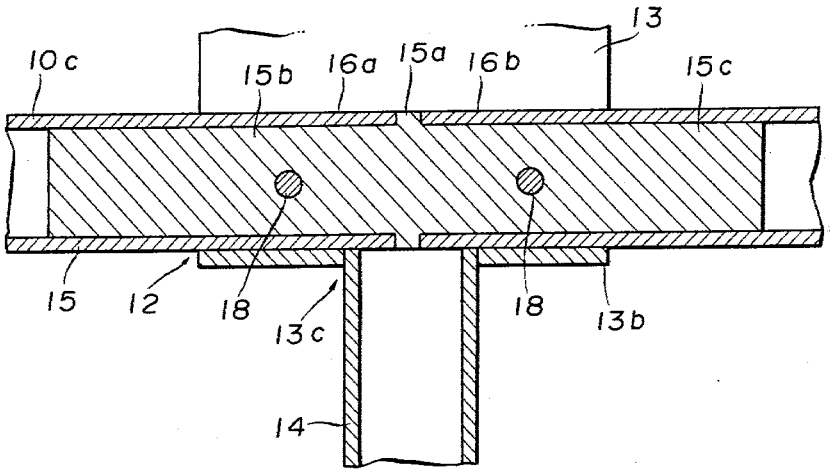
FIG. 5 is a sectional view taken in line V—V in FIG. 4.

Now the connected part 12 and the current-feeding member 13 will be described in detail with reference to FIGS. 4 and 5. The both open ends 16*a* and 16*b* of the upper horizontal part 10*c* of the zirconium alloy tube are located opposite to each other in exact alignment and an aluminum rod 15 is inserted into the both open ends of the zirconium alloy tube. This aluminum rod 15 is manufactured to the substantially same diameter as the inner diameter of the zirconium alloy tube and is provided with a frange 15*a* at the central part thereof. Thus left half 15*b* of the aluminum rod 15 extending laterally from said flange 15*a* is inserted into the left open end 16*a* of the zirconium alloy tube, while right half 15*c* is into the right open end 16*b* of the same. On the other hand, the current-feeding member 13 is made by bending an aluminum plate of high conductivity. A hook 13*a* by which the whole framework is hung to the bus bar (not shown) is formed at the top of the current-feeding member 13. This plate is further bent at the lower part of said current-feeding member 13 in such a manner as to surround the both open ends 16*a* and 16*b* of the zirconium alloy tube over the upper horizontal part 10*c* of the framework 10. The bent portion 13*b* of the plate surrounding the connected part 12 is clamped by means of bolt and nut means 17 made of stainless steel or titanium so as to contact surely with the other surface of the upper horizontal portion 10*c*. Further this bent portion 13*b* of the current-feeding member 13 is secured to the upper horizontal portion 10*c* by means of rivets 18 made of aluminum at the open ends 16*a* and 16*b* thereof, which extend through the zirconium alloy tube and the aluminum rod 15. In the bent portion 13*b* at the bottom part thereof is formed an opening 13*c* in which the upper end of said reinforcement 14 is inserted.

Figure 6:
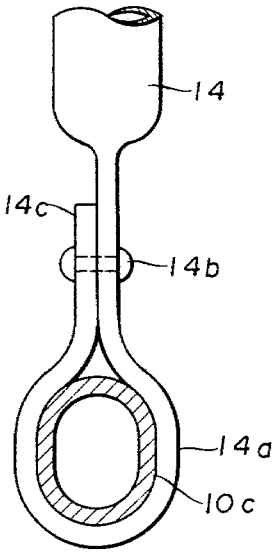
FIG. 6 is a sectional view taken in line VI—VI in FIG. 3, shown in an enlarged scale.
Figure 8:
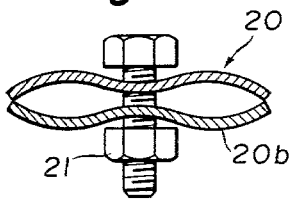
FIG. 8 is a sectional view taken in line VIII—VIII in FIG. 7.

As shown in FIG. 6, the lower end of said reinforcement 14 is deformed flat by pressing the same in the radial direction and this pressed part 14*a* is bent so as to surround the lower horizontal portion 10*d* of the framework 10 at the central part thereof and additionally is clamped by means of a rivet 14*b* made of titanium. It is to be noted that the extreme end 14*c* of the pressed portion 14*a* of the reinforcement 14 should be preferably sealed by means of welding so as to prevent this portion from being penetrated by the anolyte. Thus the lower horizontal portion 10*d* of the framework 10 is deformed to some extent due to the clamping force applied onto the pressed part 14*a* of the reinforcement 14.

Further on the lower horizontal portion 10*d* of the framework 10 are arranged a plurality of support pieces 19. These support pieces 19 are constructed of a support piece body 20 formed in such a manner that certain length of zirconium alloy tube is longitudinally cut into two pieces, then the split half is compressed to a substantially flat plate and therafter the flattened plate is bent at the middle part thereof as to surround the lower horizontal portion 10*d*, overlapping one above the other at the both ends thereof, a bolt and nut means 21 made of titanium for clamping the overlapped portions 20*b* of said support piece body 20 so as to enable the bent portion 20*a* to contact surely about the lower horizontal portion 10*d* and a hook member 22 located at the extreme end of the support piece body 20. Said hook member 22 comprises a hook 24 made of a wire of titanium arranged at the head part 23*a* of the elongated bolt 23 which extends through the hole 20*c* in the vicinity of the right end of the overlapped portion 20*b* of said support piece body 20.

Figure 7:
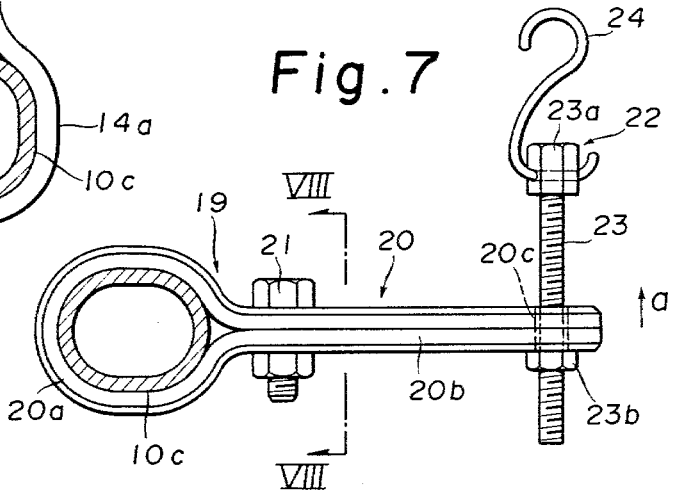
FIG. 7 is a sectional view taken in line VII—VII in FIG. 3, shown in an enlarged scale.

Instead of said bolt and nut means 21 in this embodiment as mentioned above, a rivet of titanium may be used for the purpose of holding tightly the support piece body 20 about the lower horizontal portion 10*d* of the framework. It is preferable that for a reason to be explained later the support piece body 20 is deformed to contact tightly with the outer surface of the lower horizontal portion 10*d* which is partially and locally deformed to a substantially rectangular sectional shape, as illustrated in FIG. 7, because it is required that the support piece body 20 is extended at a substantially right angle to a plane involving the four side portions of the framework 10 and this extended state is maintained.

Figure 3:
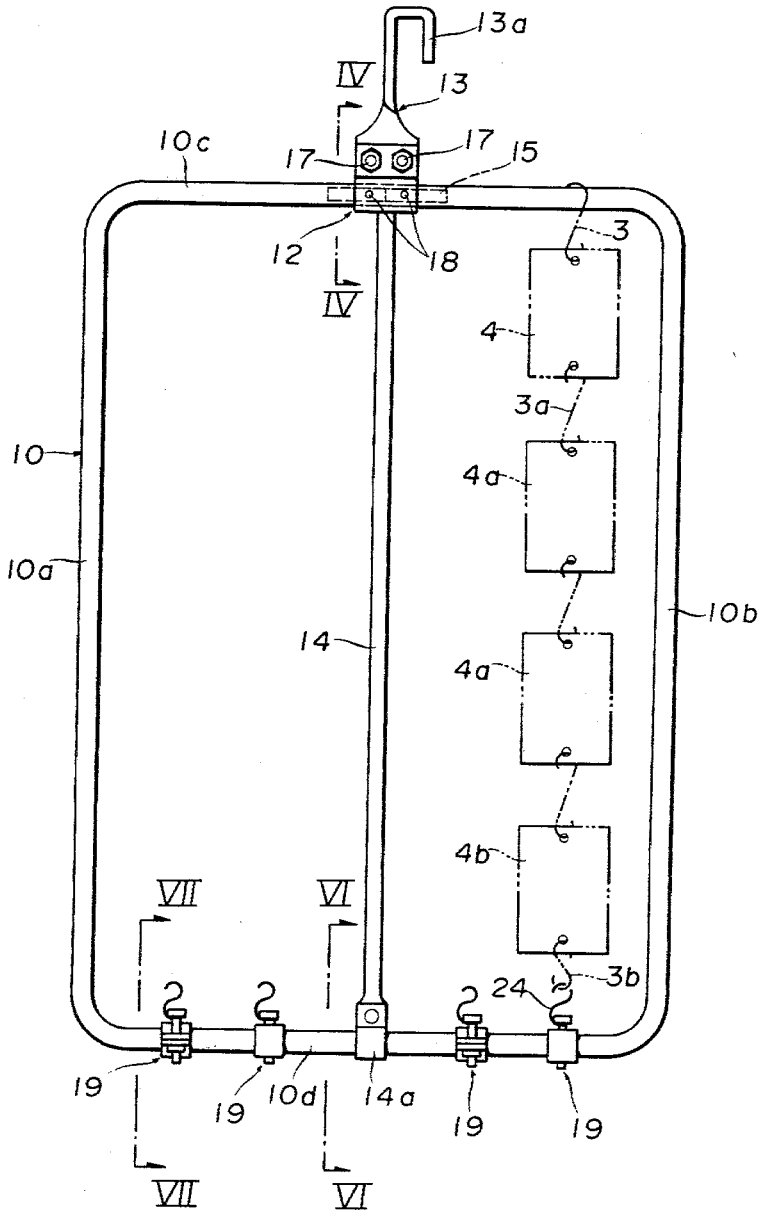
FIG. 3 is a front view of an anode member in accordance with the first embodiment of the invention.

In anodic oxidation treatment of aluminum products with the aid of the device in accordance with the first embodiment of the invention as mentioned above, the aluminum product 4 to be anodized is suspended from the upper horizontal portion 10*c* with the use of wires 3 of high conductivity such as aluminum, as illustrated by means of ghost lines in FIG. 3. Then a plurality of another products 4*a* and 4*b* are suspended one below another in a beaded fashion by means of wire 3*a* and finally the lowest product 4*b* is engaged to the hook 24 of the support piece 19 by means of wire 3*b*. Since zirconium alloy has some springiness, the support piece body 20 can be deformed in the direction as marked with the arrow in FIG. 7. Thus the support piece body 20 enables the products 4, 4*a* and 4*b* as well as the wires 3, 3*a* and 3*b* to be stretched, resulting in improved electric contacts between the products and the wires as well as between the uppermost wire 3 and the upper horizontal portion 10*c* of the framework. Moreover by adjusting the location of the nut 23*a* on the bolt 23 extending vertically at the end part of the support piece 19 the required tension can be obtained. Hitherto rubber bands were used for the same purpose as mentioned above, but they had a disadvantage that they were readily deteriorated and replaced with new ones within a short time. On the contrary the support piece 19 as described in the aforesaid embodiment has excellent resistivity against corrosion and fatigue, remarkably long durability and easy adjustability of tension and stretching.

In the above mentioned embodiment the upper end of the reinforcement 14 is just inserted into the opening 13*c* of the current-feeding member 13. The upper end of the reinforcement 14 may be constructed in the same way as the lower end such that it is pressed flat, the flattened part is wound about the open ends 16*a* and 16*b* of the upper horizontal portion 10*c* of the framework and then the same part is surrounded by the current-feeding member 13.

Figure 9:
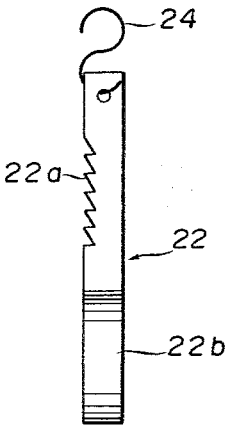
FIG. 9 is a side view illustrating another form of engagement member which is to be adapted for the anode member as shown in FIG. 3.
Figure 10:
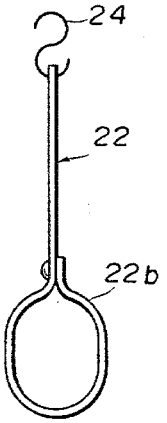
FIG. 10 is a front view of the engagement member in FIG. 9.

As another possible form of said hook member 22 the same may be constructed such that as shown in FIGS. 9 and 10, certain length of zirconium alloy tube is split and then formed with serrations 22*a* on the side edge and a finger ring 22*b* at the bottom portion thereof, wherein said serrations 22*a* are adapted to be engaged with the side edge of the opening 20*c* at the end portion of the support piece body 20 so that the position of the hook member 22 can be adjusted to obtain the required tension.

FIGS. 11 to 14 illustrate the second embodiment of the invention where the invention is applied to a rack device which is constructed of scrap of zirconium alloy tube. In this embodiment a rack body 25 is constructed of a flattened piece of scrapped zirconium alloy cylindrical tube and at the upper end of the rack body 25 is arranged a hook 25A made of aluminum fastened thereto. Further the rack body 25 is provided with a plurality of hook members 27 which comprise a pair of plate pieces 26*a* and 26*b* with the predetermined distance spaced therebetween, each of which is constructed of a flattened piece of split zirconium alloy tube. Each hook member 27 is constructed such that a pair of plate pieces 26*a* and 26*b* are fastened to the rack body 25 with a bolt and nut means or rivet 28 in such a manner that paid plate pieces 26*a* and 26*b* are diverged from each other, said rack body 25 being interposed between the both plate pieces 26*a* and 26*b*. Since the plate pieces 26*a* and 26*b* of flattened zirconium alloy tube have excellent springiness, a product 4 to be anodized can be carried by the plate pieces 26*a* and 26*b* by compressing the end parts of the plate pieces 26*a* and 26*b* toward each other and then inserting the deformed end parts in the hollow or recessed portion of the product 4, as illustrated by ghost lines in FIG. 13. As a result excellent electric contacts are ensured between the plate pieces 26*a* and 26*b* and the product 4. In this embodiment the plate pieces 26*a* and 26*b* may be of course bent toward each other at the end parts thereof so that the product 4 can be clamped therebetween.

Further the flattened plate for the rack body 25 may be provided by inserting an aluminum rod 29 in the zirconium alloy tube prior to compressing, rolling or swaging, said aluminum rod 29 having a substantially same outer diameter as the inner diameter of the zirconium alloy tube and then applying compressive deformation to the zirconium alloy tube together with the aluminum rod 29 inserted therein. In this way higher conductivity is ensured than in case the zirconium alloy tube is subjected just to compression and moreover the hook member 27 may be secured to the rack body 25 by means of spot welding. Incidentally, a rod of other metallic material such as aluminum alloy, copper, copper alloy, titanium, titanium alloy and so forth may be used instead of said aluminum rod 29. Further, instead of inserting the aluminum rod 29 molten aluminum, aluminum alloy or the like may be poured into the zirconium alloy tube so as to form a core of aluminum or the like thereby.

Figure 15:
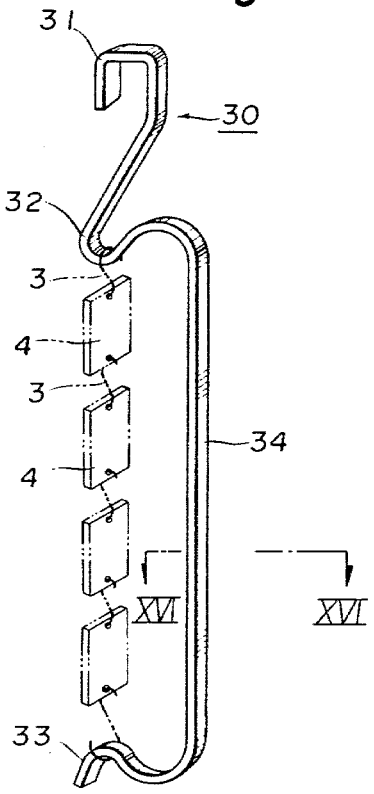
FIG. 15 is a perspective view of an anode member in accordance with the third embodiment of the invention.
Figure 14:
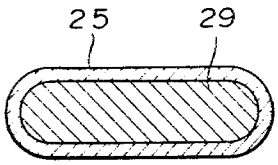
FIG. 14 is a sectional view of another form of rack body, shown in an enlarged scale.
Figure 16:
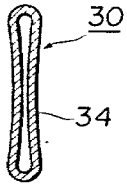
FIG. 16 is a cross sectional view of the anode member taken in line XVI—XVI in FIG. 15, shown in an enlarged scale.

FIGS. 15 and 16 illustrate the third embodiment of the invention where a flattened plate piece of zirconium alloy tube is used therefor. In FIGS. 15 and 16 a rack frame 30 is made in one piece by compressing a certain length of zirconium alloy tube to a flattened plate piece and then bending the flattened plate piece to the predetermined configuration. This rack frame 30 is provided with a hook portion 31 integral therewith at the upper end thereof and further is formed with an upper engagement portion 32 below said hook portion 31, said upper engagement portion 32 being bent with a downward convex curvature. Moreover the rack frame 30 is provided with a lower engagement portion 33 opposite to the upper engagement portion 32, said lower engagement portion 33 being bent with an upward convex curvature. Thus the upper and lower engagement portions 32 and 33 are connected via the straight portion 34 which is located offset from the line extending between said both engagement portions so that they are elastically deformed toward and away from each other. Hence in this embodiment the products 4 and the aluminum wires 3 are stretched by means of the rack frame 30 itself.

Figure 11:
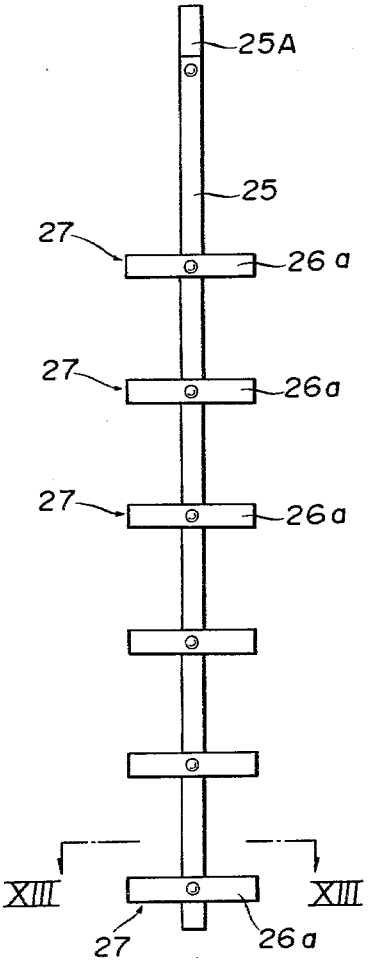
FIG. 11 is a front view of an anode member in accordance with the second embodiment of the invention.
Figure 12:
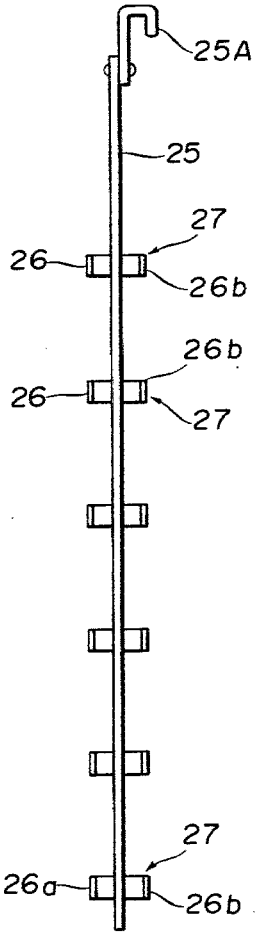
FIG. 12 is a side view of the member in FIG. 11, seen from the right side.
Figure 13:
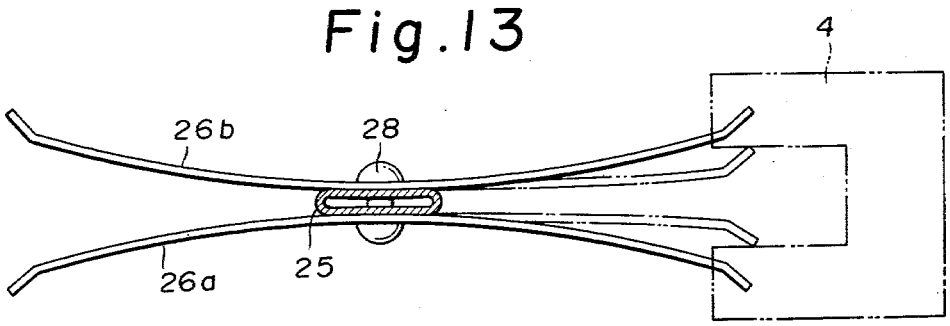
FIG. 13 is a sectional view of the member taken in line XIII—XIII in FIG. 11, shown in an enlarged scale.

In each of the aforesaid embodiments the invention is described with the constructive material of zirconium alloy tube or machine-worked zirconium alloy tube, but it is not always limited to this type of constructive material. In practice constructive material may be used which is prepared by melting scrap such as rejected product of zirconium alloy tube or the like and then working to a plate. The inventors of the invention have found out that the substantially same results can be obtained as those in case of machine-worked constructive material of zirconium alloy tube used for anode member, when compressing several pieces of tube of zirconium alloy, binding them, melting a bundle of flattened zirconium alloy tube as an electrode in a vacuum arc melting furnace, pouring molten zirconium alloy into a water-cooled copper mold, forging solidified zirconium alloy ingot in the hot state, further rolling it a plate having thickness of 1 to 5 mm, constructing an anode member as illustrated in FIGS. 11 to 13 with the use of rolled plates, and then setting aluminum products on the rack of anode member for anodic oxidation treatment.

In this case vacuum melting of zirconium alloy tubes causes a little bit of increase in $O_2$ and $N_2$ contents and some fluctuation of contents of Cr, Ni and Sn in zirconium alloy ingot, each of which is alloying element, particularly reduced content of Cr due to its vaporization, but the experiments for examining characteristics showed that there is little significant difference among zirconium alloy tube, machine-worked plate and remelted material of the same with respect to electrical and chemical characteristics as well as resistivity against anolyte and pre treatment agent. Thus it can be concluded that anode member made of remelted zirconium alloy assures remarkably excellent characteristics over those in case of titanium used as anode member in the same manner as in case of zirconium alloy tube and/or machine-worked zirconium alloy tube.

Moreover remelted zirconium alloy tube having a thickness different from that of the original scrap zirconium alloy tube, for instance, 0.6 mm may be available for anode member. In this case it can be expected that this remelted zirconium alloy tube ensures increased mechanical strength necessary for constructing an anode member and improved sectional current capacity as required. Further a combination of scrap zirconium alloy tube and plate of remelted zirconium alloy may be available for anode member constructed as illustrated in FIGS. 3 to 10. Moreover constructive material which is prepared by melting remelted zirconium alloy once more for alloying to the required composition may be of course used for anode member. Further scrap zirconium alloy plate or constructive material which is prepared by remelting scrap zirconium alloy plate and then working remelt material to tube or plate having the predetermined thickness and length may be of course available for constructing an anode member.

Since the several embodiments of the present invention have been described above, operation of anodic oxidation will be described below.

First anode members in the form of framework as illustrated in FIG. 3 are constructed using scrap of zirconium alloys A, B, C and D. Then 4 pieces of aluminum products (50 mm×100 mm×20 mm) are suspended by each of the anode members with aluminum wires (3 mm in diameter) located between the adjacent aluminum products. Thereafter they are subjected to anodic oxidation treatment using 15% $H_2SO_4$ at 20° C. as anolyte. It was recognized that when measuring fluctuation of bath voltage for each of the anode members at current density of 1.5 A/dm$^2$ as time elapses, the bath voltage varies from 15 V to 20 V without remarkable fluctuation in bath voltage for the time length from starting of anodic oxidation till completion of the same. In addition experimental tests were repeated with the aluminum products racked at different position on the anode member, but no wrong electric contact was recognized for each of the anode members. Further it was recognized that there is very little variation in anodized film among a plurality of aluminum products set on single anode member.

Since the anode member in accordance with the invention is constructed of zirconium alloy, as mentioned above, there is less current flow-out from the anode member itself in the course of anodic oxidation treatment, whereby the anode member has remarkably less power loss than that of anode member of aluminum. Moreover since the anode member itself wears little during anodic oxidation, it can be repeatedly used for a substantially longer period of time than anode member of aluminum. Further the anode member of the invention has characteristic advantages over those of aluminum and titanium, since it has remarkably higher resistivity against degreasing agent used before anodic oxidation treatment and chemical polishing agent than anode member of aluminum. The anode member in accordance with the invention has another advantage that zirconium alloy tubes are manufactured at reduced cost and consequently anode member itself is constructed at lower manufacturing cost, since short dimensioned products of zirconium alloy tube or plate which are hitherto rejected as scrapped are utilized in an effective manner for constructing an anode member in accordance with the present invention.

It is to be noted that this invention shouldn't be limited only to anodic oxidation treatment of aluminum products, but may be applicable to anode members (anode basket) for other purpose of chemical treatment, for instance, electrical plating of copper, tin, zinc, cadmium, nickel, silver etc., wherein anolyte has no chloric ion contained therein.

Finally it should be of course understood that the invention may be changed or modified without any departure from the spirit and scope of the invention.

What is claimed is:

1. An anode member for anodic oxidation treatment, wherein said anode member is constructed of at least one of: constructive zirconium alloy material or scrap of zirconium alloy tube such as rejected product or short dimensioned products.

2. An anode member as set forth in claim 1, wherein said anode member is constructed of constructive material of zirconium alloy, which is prepared by machine-working scrap of zirconium alloy tube.

3. An anode member as set forth in claim 1, wherein said anode member is constructed of scrapped zirconium alloy tube, of which hollow space is filled with one metallic material selected from the group of consisting of aluminum, aluminum alloy, copper, copper alloy, titanium, and titanium alloy.

4. An anode member as set forth in claim 1, wherein said anode member is constructed of constructive material of zirconium alloy, which is prepared by remelting the scrap of zirconium alloy tube and then working solidified zirconium alloy ingot to plate.

5. An anode member as set forth in claim 1, wherein said anode member is constructed of constructive material of zirconium alloy, which is prepared by remelting and refining scrap of zirconium alloy tube so as to ensure the required composition.

6. An anode member as set forth in claim 1, wherein said zirconium alloy consists of Sn 0.05–3.0 wt %, Hf 0.001–4.5 wt %, Fe 0.001–1.0 wt %, Cr 0.001–1.0 wt %, Ni 0.001–1.0 wt %, O 0.005–0.5 wt %, N 0.001–0.05 wt %, 0.001–0.2 wt % one or more than one elements selected from Cu, Co, Cd, Mn, Al, Ti, Si, C, P, Mo, Bi, V, Sb, Nb, W and B and zirconium balance.

7. An anode member as set forth in claim 1, wherein said zirconium alloy is a zirconium alloy containing Nb 1–3 wt %.

8. An anode member as set forth in claim 1, wherein said zirconium alloy consists of 1.2–1.7 wt % Sn, 0.07–0.20 wt % Fe, 0.05–0.15 wt % Cr, 0.03–0.08 wt % Ni, 0.18–0.38 wt % Fe+Cr+Ni and the remainder zirconium.

9. An anode member as set forth in claim 1, wherein said zirconium alloy consists of 1.2–1.7 wt % Sn, 0.18–0.24 wt % Fe, 0.07–0.13 wt % Cr, 0.28–0.37 wt % Fe+Cr and the remainder zirconium.

10. An anode member as set forth in claim 1 constructed in the form of a racking frame comprising:

a framework made of scrap zirconium alloy tube bent into a closed geometric shape;

a current-feeding member of a highly conductive material which is fastened to said framework; and a tubular reinforcement of zirconium alloy extending between two opposed prints on said framework.

11. An anode member in accordance with claim 10 wherein said framework is bent substantially into a rectangular shape so as to include upper and lower horizontal portions, said current feeding member being made of aluminum and said reinforcement extending between said horizontal portions.

12. An anode member in accordance with claim 10 wherein said framework is formed from a length of tube having first and second ends, said anode member further comprising:

a rod member made of a highly conductive material and having an outside diameter substantially equal to the inside diameter of said framework;

a radially outwardly directed flange on said rod member intermediate the ends thereof and made of a highly conductive material; and said rod member being pressed into the ends of said framework so that the framework ends abut said flange.

13. An anode member in accordance with claim 12 wherein said current feeding member includes a substantially flattened portion wrapped about said framework and over said ends and said flange, said flattened portion having an opening therein dimensioned to receive one end of said reinforcement, the other end of said reinforcement being secured to said framework opposite said current feeding member.

14. An anode member in accordance with claim 13 further including a support piece for retaining under controlled tension a product to be treated which is mounted between said support piece and an opposed point on said framework, said support piece comprising:

a resilient member extending outwardly from the plane of said framework;

a retaining member including means for holding a portion of said product; and means mounting said retaining member to said resilient member for selectively adjusting the distance of said holding means from said opposed point, whereby the tension applied to said product may be adjusted.

15. An anode member in accordance with claim 14 wherein said means for selectively adjusting comprises a threaded shaft on said retaining member and adjustable thread-receiving means in a fixed relationship to said resilient member for selectively moving said shaft towards and away from said opposed point.

16. An anode member in accordance with claim 14 wherein said means for selectively adjusting comprises a plurality of serrations on at least a portion of said retaining member, each serration comprising a substantially horizontal upper edge and an inclined lower edge, said resilient member having an opening therein through which the serrated portion of said retaining member extends and also including an engagement surface facing away from said opposed point, the position of said retaining member being adjusted by sliding the same through said opening to a selected serration and urging the horizontal portion thereof against said engagement surface.

17. An anode member as set forth in claim 1 wherein said anode member is in the form of a rack device for retaining a plurality of products to be treated, said anode member comprising:

an elongated rack body made of a flattened piece of scrapped zirconium alloy tube;

a hook made of a highly conductive material and extending above said rack body; and at least one product-holding member comprising a pair of spaced, resilient plate pieces extending laterally of said rack body on opposite sides thereof so as to be separated by a predetermined distance corresponding to the thickness of said rack body, said opposed plate pieces cooperating to hold product through their mutual resilience.

18. An anode member as set forth in claim 1 wherein said anode member is in the form of a rack frame for holding a product to be treated, said rack frame being made from a single piece of scrap of zirconium alloy tube compressed to a flattened plate piece.

19. An anode member in accordance with claim 18 wherein said anode member comprises:

a hook portion formed at one end of said tube by bending the same;

a first s-shaped bend formed in said tube near the end opposite said hook portion by bending said tube toward and then away from said hook portion; and a second s-shaped bend in said tube near said hook portion formed by bending said hook portion end toward and then away from said first s-shaped bend;

said s-shaped bends defining spaced, resilient mounting points between which said product is mounted and held under tension as a result of the resilience of said s-shaped bends.

* * * * *